US010871315B2

(12) United States Patent
Kerstner et al.

(10) Patent No.: US 10,871,315 B2
(45) Date of Patent: Dec. 22, 2020

(54) REFRIGERANT CIRCUIT FOR A COOLING AND/OR FREEZING APPLIANCE

(71) Applicants: LIEBHERR-HAUSGERATE LIENZ GMBH, Lienz (AT); LIEBHERR-HAUSGERATE OCHSENHAUSEN GMBH, Ochsenhaussen (DE)

(72) Inventors: Martin Kerstner, Wurzburg (DE); Jochen Hiemeyer, Karlstadt (DE); Michael Freitag, Erlabrunn (DE)

(73) Assignees: LIEBHERR-HAUSGERATE LIENZ GMBH, Lienz (AT); LIEBHERR-HAUSGERATE OCHSENHAUSEN GMBH, Ochsenhausen (DE)

( * ) Notice: Subject to any disclaimer, the term of this patent is extended or adjusted under 35 U.S.C. 154(b) by 173 days.

(21) Appl. No.: 16/084,241

(22) PCT Filed: Mar. 8, 2017

(86) PCT No.: PCT/EP2017/000310
§ 371 (c)(1),
(2) Date: Sep. 12, 2018

(87) PCT Pub. No.: WO2017/157509
PCT Pub. Date: Sep. 21, 2017

(65) Prior Publication Data

US 2019/0063803 A1 Feb. 28, 2019

(30) Foreign Application Priority Data

Mar. 16, 2016 (DE) ..... 10 2016 003 244
Jan. 12, 2017 (DE) ..... 10 2017 000 237

(51) Int. Cl.
*F25B 1/00* (2006.01)
*F25B 39/04* (2006.01)
(Continued)

(52) U.S. Cl.
CPC ..... *F25B 39/04* (2013.01); *F25B 39/02* (2013.01); *F25B 39/026* (2013.01); *F25B 41/04* (2013.01);
(Continued)

(58) Field of Classification Search
CPC ..... F25D 21/04; F25D 11/02; F25D 11/006; F25D 21/14; F25D 21/12; F25D 21/00;
(Continued)

(56) References Cited

U.S. PATENT DOCUMENTS 2,310,657 A * 2/1943 Shively ..... F25D 11/022 62/175
2010/0100243 A1* 4/2010 Lee ..... F25D 11/022 700/275
(Continued)

FOREIGN PATENT DOCUMENTS

AT 129428 B 8/1932
DE 257290 A1 6/1988
(Continued)

OTHER PUBLICATIONS

Search Report issued in corresponding German Patent Application No. 10 2016 003 244.8 dated Dec. 13, 2016 (9 pages).
(Continued)

*Primary Examiner* — Henry T Crenshaw
*Assistant Examiner* — Kamran Tavakoldavani
(74) *Attorney, Agent, or Firm* — Kilyk & Bowersox, P.L.L.C.

(57) ABSTRACT

The present invention relates to a refrigerant circuit for a refrigerator and/or freezer, with at least one body and with
(Continued)

Figure 1:
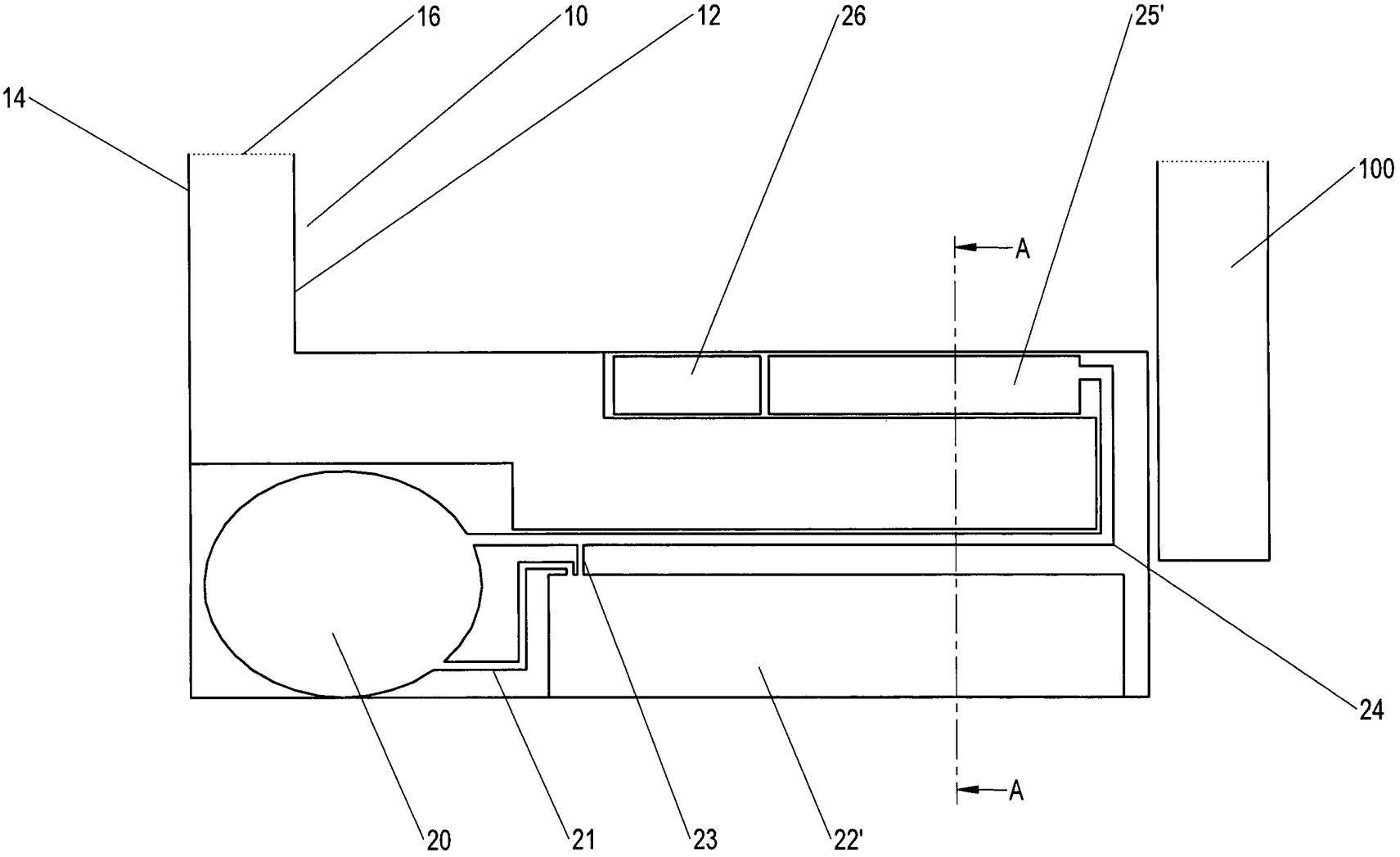

at least one cooled interior space arranged in the body, wherein the refrigerant circuit includes at least one evaporator and at least one condenser as well as at least one compressor, wherein the condenser is partly or completely arranged in a liquid bath that at least partly absorbs the condensation heat in operation of the refrigerant circuit.

16 Claims, 2 Drawing Sheets

(51) Int. Cl.

| | |
|---|---|
| ***F25B 39/02*** | (2006.01) |
| ***F25D 11/00*** | (2006.01) |
| ***F25B 41/04*** | (2006.01) |
| ***F25D 11/02*** | (2006.01) |

(52) U.S. Cl.
CPC ..... *F25D 11/00* (2013.01); *F25D 11/02* (2013.01); *F25B 2339/047* (2013.01); *F25B 2400/24* (2013.01)

(58) Field of Classification Search
CPC ..... F25D 23/003; F25D 25/025; F25D 2321/1412; F28D 15/0266; F28D 15/0275; F25B 2339/046; F25B 49/02; F25B 49/022; F25B 2600/02; F25B 2600/112; F25B 2600/11
See application file for complete search history.

(56) References Cited

U.S. PATENT DOCUMENTS

| | | | | |
|---|---|---|---|---|
| 2015/0292775 | A1* | 10/2015 | Ma | F25B 1/00 62/115 |
| 2016/0209097 | A1* | 7/2016 | Choueifati | F25B 49/025 |

FOREIGN PATENT DOCUMENTS

| | | | | |
|---|---|---|---|---|
| DE | 293638 | A5 | 9/1991 | |
| DE | 19951766 | A1 | 5/2001 | |
| DE | 19951766 | A1 * | 5/2001 | F25D 21/14 |
| DE | 10129999 | A1 * | 1/2003 | F25B 39/04 |
| DE | 10129999 | A1 | 1/2003 | |
| DE | 60214056 | T2 | 3/2007 | |
| DE | 102007062006 | A1 | 6/2009 | |
| DE | 102007062022 | A1 | 6/2009 | |
| DE | 102011076169 | A1 | 9/2012 | |
| DE | 102013005476 | A1 | 10/2013 | |
| DE | 102012017345 | A1 | 5/2014 | |
| EP | 0794396 | A1 | 9/1997 | |
| EP | 0866289 | A2 | 9/1998 | |
| EP | 1229293 | A1 | 8/2002 | |
| FR | 880816 | A | 4/1943 | |
| GB | 378261 | A | 8/1932 | |
| KR | 20070071224 | A * | 7/2007 | |
| WO | 02066911 | A1 | 8/2002 | |
| WO | 2008028790 | A1 | 3/2008 | |
| WO | 2014065938 | A1 | 5/2014 | |
| WO | 2015100119 | A1 | 7/2015 | |
| WO | 2016003142 | A1 | 3/2016 | |

OTHER PUBLICATIONS

Search Report issued in corresponding German Patent Application No. 10 2017 000 237.1 dated Sep. 20, 2017 (9 pages).

International Search Report and Written Opinion (with English translation of International Search Report) issued in corresponding International Patent Application No. PCT/EP2017/000310 dated May 16, 2017 (10 pages).

* cited by examiner

REFRIGERANT CIRCUIT FOR A COOLING AND/OR FREEZING APPLIANCE

This application is a National Stage Application of PCT/EP2017/000310, filed Mar. 8, 2017, which claims priority to German Patent Application No. 10 2017 000 237.1 filed Jan. 12, 2017 and German Patent Application No. 10 2016 003 244.8 filed Mar. 16, 2016.

The present invention relates to a refrigerant circuit for a refrigerator and/or freezer with at least one body and at least one cooled interior space arranged in the body, wherein the refrigerant circuit includes at least one evaporator and at least one condenser as well as at least one compressor.

Such refrigerant circuits are known from the prior art.

They serve for cooling the cooled interior space of a refrigerator or freezer, wherein cooling is effected by the evaporator in which the refrigerant evaporates. The heat withdrawn in this way from the cooled interior space usually is discharged to the environment via the condenser.

It is the object underlying the present invention to develop a refrigerant circuit as mentioned above to the effect that a particularly efficient configuration of the refrigerant circuit is achieved.

This object is solved by a refrigerant circuit according to the features of the claimed invention. Accordingly, it is provided that the condenser is partly or completely arranged in a liquid bath which at least partly absorbs the condensation heat in operation of the refrigerant circuit, i.e. in operation of the compressor.

Preferably, it is provided that the liquid in the liquid bath is water.

The liquid bath is configured such that the waste heat of the condenser is distributed in the liquid bath by means of free convection or also by means of enforced convection.

Preferably, it is provided that the liquid bath has a first heat transfer surface from the condensers into the liquid of the liquid bath and a second heat transfer surface from the liquid to a further heat transfer medium. It preferably is provided that the second heat transfer surface is greater than the first heat transfer surface.

The further heat transfer medium can be air. This air preferably can be conveyed along the second heat transfer surface by means of enforced convection, i.e. conveyance by a fan, whereby a particularly efficient heat dissipation is ensured.

In this case, the heat thus is not transferred directly from the condenser into the air, but indirectly via the liquid bath or the liquid present therein.

Furthermore, it can be provided that the condenser and/or the evaporator of the refrigerant circuit is formed as a tube.

The liquid bath preferably includes one or more channels that can be traversed by air, preferably by ambient air.

The present invention provides for using a compressor that is not speed-controlled or frequency-controlled, but can operate only at a constant speed.

The condenser can be arranged in or on a latent heat storage medium, so that the evaporation cold obtained in operation of the refrigerant circuit is at least partly absorbed in the latent heat accumulator.

It is conceivable that at least 50 percent of the evaporator have a distance of <15 mm to the latent heat storage medium.

It is furthermore conceivable that the evaporator is directly connected with the latent heat storage medium or is embedded in the same.

In a further aspect of the invention the latent heat storage medium has at least one first heat transfer surface from the evaporator into the latent heat storage medium and a second heat transfer surface from the latent heat storage medium to a further heat transfer medium, in particular to the air in the cooled interior space.

In this case, too, it preferably is provided that the second heat transfer surface is greater than the first heat transfer surface.

For conveying the air cooled on the evaporator at least one fan preferably is provided.

Control means can be present, which are configured to actuate the fan such that its speed depends on the temperature difference between the cooled interior space and the latent heat storage medium.

Furthermore, it can be provided that there are control means which are configured to actuate the compressor such that the same is actuated in dependence on the temperature of the latent heat storage medium, wherein the compressor is switched on upon exceedance of a particular temperature above the melting temperature of the latent heat storage medium.

The control means can be configured such that the compressor remains switched on for a specified time period.

It is furthermore conceivable that there are control means which are configured to actuate the compressor such that the same is switched on when a particular temperature is exceeded in the cooled interior space and the fan operates at maximum speed.

The present invention furthermore relates to a refrigerator and/or freezer with at least one refrigerant circuit as claimed herein.

It is preferred when the refrigerant circuit is mounted on the refrigerator and/or freezer as a pre-mounted assembly.

Figure 2:
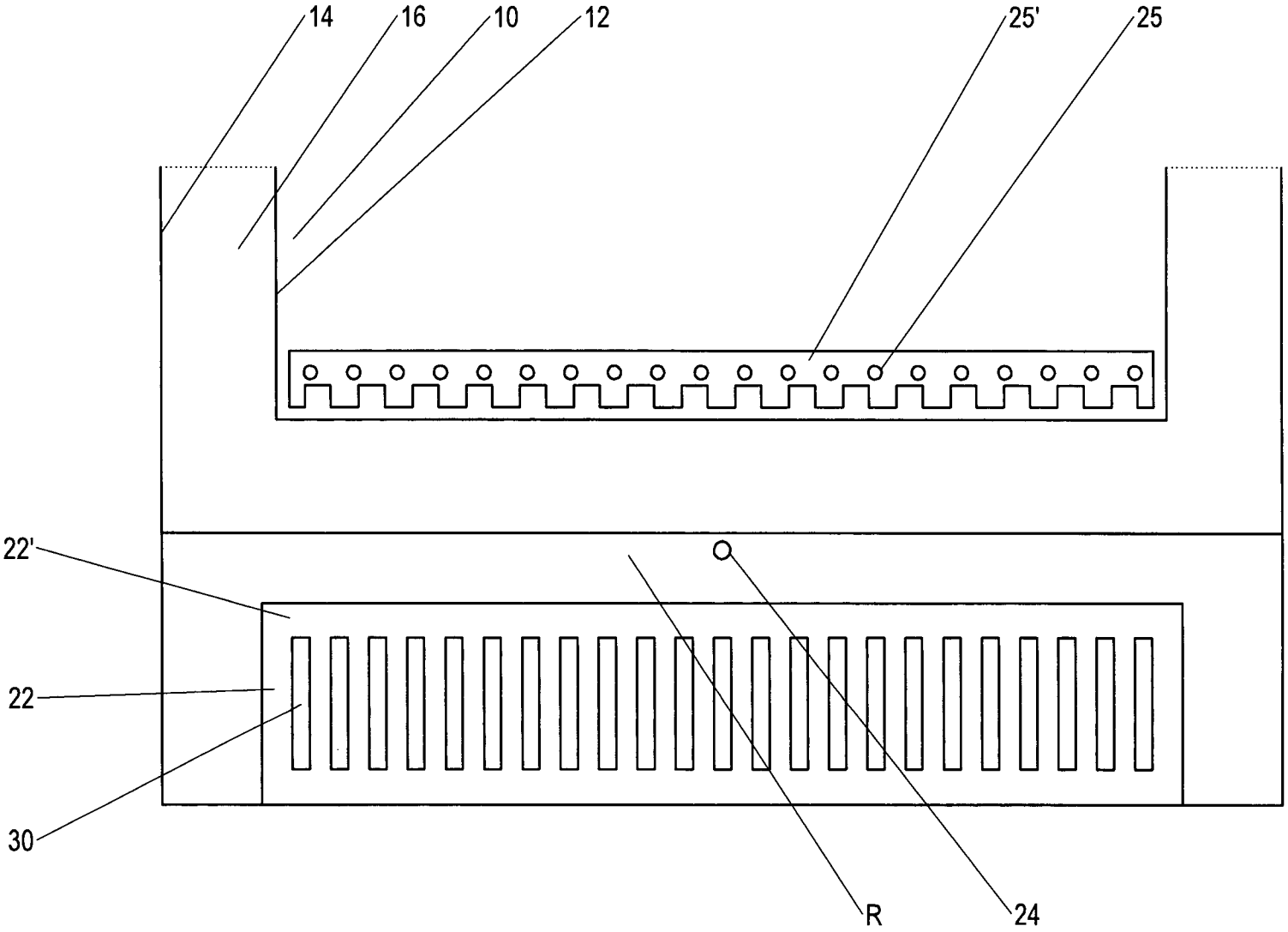

Further details and advantages of the invention will be explained in detail with reference to an exemplary embodiment illustrated in the drawing, in which:

FIG. 1: shows a schematic longitudinal sectional view through the lower part of a refrigerator and/or freezer according to the invention, FIG. 2: shows another schematic longitudinal sectional view according to the sectional line A-A in FIG. 1.

With reference numeral 10, FIG. 1 shows the body of a refrigerator and/or freezer according to the invention.

The body includes an inner container 12 as well as an outer shell 14. In between a heat insulation is disposed, which as a conventional heat insulation can consist e.g. of PU foam or also of a full vacuum insulation.

By a full vacuum insulation in accordance with the present invention it preferably is meant that the body and/or the closure element of the appliance consists of a coherent vacuum insulation space for more than 90% of the insulation surface.

Preferably, no further heat insulation materials are present apart from the full vacuum insulation.

Typically, the envelope of the film bag is a diffusion-tight casing by means of which the gas input in the film bag is reduced so much that the gas-input-related rise in the thermal conductivity of the vacuum insulation body obtained is sufficiently low over its service life.

Service life for example is understood to be a period of 15 years, preferably of 20 years, and particularly preferably of 30 years. Preferably, the rise in the thermal conductivity of the vacuum insulation body due to the input of gas during its service life is <100% and particularly preferably <50%.

Preferably, the area-specific gas permeation rate of the casing is $<10^{-5}$ mbar*l/s*m$^2$ and particularly preferably $<10^{-6}$ mbar*l/s*m$^2$ (as measured according to ASTM D-3985). This gas permeation rate applies for nitrogen and oxygen. For other types of gas (in particular steam) the gas permeation rates likewise are low, preferably in the range of $<10^{-2}$ mbar*l/s*m$^2$ and particularly preferably in the range of $<10^{-3}$ mbar*l/s*m$^2$ (as measured according to ASTM F-1249-90). Preferably, the aforementioned small rises in thermal conductivity are achieved by these low gas permeation rates.

The above-mentioned values are exemplary, preferred indications that do not limit the invention.

The full vacuum insulation can be present in the body and/or in the closure element, such as for example in a door 100 or flap.

The refrigerant circuit comprises the compressor 20, the condenser 22, the capillary 23 and the evaporator 25 as well as the line 21 extending between the compressor 20 and the condenser 22 and the suction line extending between the evaporator 25 and the compressor 20.

These components together form a C-shaped assembly, which in the pre-mounted condition is put onto the body. The assembly furthermore includes a fan 26 whose function it is to convey the air cooled by the evaporator into the cooled interior space.

The assembly furthermore can include actuators, in particular valves and/or control or regulation elements that control or regulate the operation of the refrigerant circuit.

The condenser 22 is configured as a conduit that extends in a water bath 22'.

The evaporator 25 likewise is configured as a conduit that extends in a latent heat accumulator 25'.

Due to the condenser waste heat a convection is obtained in the water bath 22', which transports the waste heat of the condenser into the bath and at the same time transfers the same to a large heat exchanger surface. This convective coupling is necessary, as by a pure thermal conduction no sufficient coupling to the liquid bath can take place, without the length of the condenser selectively becoming unnecessarily high or the construction of the liquefier becoming unnecessarily complex e.g. due to slats.

On the evaporator side the PCM tank (PCM=Phase Change Material) is disposed.

As can be taken from the sectional view of FIG. 2, the tubes of the condenser 22 and the tubes of the evaporator 25 for the most part extend within the water bath in the heat exchanger 22' or for the most part in the heat exchanger or latent heat accumulator 25'.

The heat exchanger 22 includes a plurality of channels 30 which by means of one or more fans are traversed by air. Thus, an effective dissipation of the condenser waste heat from the bath is possible.

The evaporator 25 is arranged in the latent heat accumulator 25' which buffers the evaporator cold obtained, while the compressor operates.

The surface of the conduits of the evaporator and the condenser is smaller than the surfaces of the heat exchangers 22' and 25' to the air that flows around the heat exchangers.

Reference numeral 24 in FIG. 2 designates a suction line from the evaporator to the compressor. The same extends through an edge-side recess R in the body or in the vacuum insulation body. The suction line and the recess are insulated or overinsulated by means of a conventional heat insulation means, such as e.g. PU foam.

The invention claimed is:

1. A refrigerant circuit for a refrigerator and/or freezer, with at least one body and with at least one cooled interior space arranged in the body, wherein the refrigerant circuit includes at least one evaporator and at least one condenser as well as at least one compressor, wherein the condenser is partly or completely arranged in a liquid bath which at least partly absorbs the condensation heat in operation of the refrigerant circuit, and the evaporator is arranged in or on a latent heat storage medium, so that the evaporation cold obtained in operation of the refrigerant circuit is at least partly absorbed in the latent heat accumulator and control means are present which are configured to actuate the compressor such that the same is actuated in dependence on the temperature of the latent heat storage medium, wherein the compressor is switched on upon exceedance of a particular temperature above the melting temperature of the latent heat storage medium.

2. The refrigerant circuit according to claim 1, wherein the liquid in the liquid bath is water and/or that the liquid bath is configured such that the waste heat of the condenser is distributed in the liquid bath by means of free or enforced convection.

3. The refrigerant circuit according to claim 1, wherein the liquid bath has a first heat transfer surface from the condenser into the liquid of the liquid bath and a second heat transfer surface from the liquid to a further heat transfer medium.

4. The refrigerant circuit according to claim 3, wherein the second heat transfer surface is greater than the first heat transfer surface and/or that the further heat transfer medium is air, wherein conveying means are present, by means of which the air is conveyed along the second heat transfer surface.

5. The refrigerant circuit according to claim 1, wherein the condenser and/or the evaporator is formed as a tube.

6. The refrigerant circuit according to claim 1, wherein the liquid bath includes one or more channels that can be traversed by air.

7. The refrigerant circuit according to claim 1, wherein the compressor is not frequency-controlled.

8. The refrigerant circuit according to claim 1, wherein the latent heat storage medium has at least one first heat transfer surface from the evaporator into the latent heat storage medium and that the latent heat storage medium has at least one second heat transfer surface from the latent heat storage medium to a further heat transfer medium.

9. The refrigerant circuit according to claim 8, wherein the second heat transfer surface is greater than the first heat transfer surface and/or that the further heat transfer medium is air, wherein conveying means are present, by means of which the air is conveyed along the second heat transfer surface.

10. The refrigerant circuit according to claim 9, wherein the conveying means are at least one fan and that control means are present, which are configured to actuate the fan such that its speed depends on the temperature of the cooled interior space.

11. A refrigerator and/or freezer comprising the refrigerant circuit according to claim 1.

12. The refrigerator and/or freezer according to claim 11, wherein the refrigerant circuit is mounted on the refrigerator and/or freezer as a pre-mounted assembly.

13. The refrigerant circuit according to claim 1, wherein the liquid bath includes one or more channels that can be traversed by ambient air.

14. The refrigerant circuit according to claim 9, wherein the conveying means are at least one fan and that control means are present, which are configured to actuate the fan such that its speed depends on the temperature difference between the cooled interior space and the latent heat storage medium.

15. The refrigerant circuit according to claim 14, wherein control means are present which are configured to actuate the compressor such that the same is switched on when a particular temperature is exceeded in the cooled interior space and the fan operates at maximum speed.

16. The refrigerant circuit according to claim 1, wherein the control means are configured such that the compressor remains switched on for a specified time period.

* * * * *